US012415247B2

(12) United States Patent
Higelin et al.

(10) Patent No.: US 12,415,247 B2
(45) Date of Patent: Sep. 16, 2025

(54) DISC TOOL

(71) Applicant: Festool GmbH, Wendlingen (DE)

(72) Inventors: Michael Higelin, Köngen (DE); Florian Beck, Römerstein-Strohweiler (DE); Mutasem Rabah, Wendlingen (DE); Ulrich Kasper, Wangen (DE); Stefan Tulodziecki, Neuhausen (DE)

(73) Assignee: FESTOOL GMBH, Wendlingen (DE)

( * ) Notice: Subject to any disclaimer, the term of this patent is extended or adjusted under 35 U.S.C. 154(b) by 386 days.

(21) Appl. No.: 17/890,388

(22) Filed: Aug. 18, 2022

(65) Prior Publication Data

US 2023/0059593 A1 Feb. 23, 2023

(30) Foreign Application Priority Data

Aug. 19, 2021 (DE) ..... 10 2021 121 566.8
Jul. 13, 2022 (EP) ..... 22184758

(51) Int. Cl.
*B24B 23/02* (2006.01)
*B24B 7/18* (2006.01)
*B24D 9/08* (2006.01)

(52) U.S. Cl.
CPC ..... *B24B 23/028* (2013.01); *B24D 9/08* (2013.01); *B24B 7/186* (2013.01); *B24D 9/085* (2013.01)

(58) Field of Classification Search
CPC ..... B24B 23/028; B24B 23/02; B24B 7/186; B24B 7/18; B24B 7/182; B24B 41/002;
(Continued)

(56) References Cited

U.S. PATENT DOCUMENTS 2,142,182 A 1/1939 Dempsey
2,279,673 A * 4/1942 Graenser ..... B24D 9/08 451/511
(Continued)

FOREIGN PATENT DOCUMENTS

DE 282 193 A5 9/1990
DE 20 2006 002 844 U1 4/2006
(Continued)

OTHER PUBLICATIONS

European Search Report of Dec. 5, 2022.

*Primary Examiner* — David S Posigian
*Assistant Examiner* — Michael A Gump
(74) *Attorney, Agent, or Firm* — Hoffmann & Baron, LLP

(57) ABSTRACT

A disc tool for a processing machine for grinding and/or polishing a workpiece (W); wherein the disc tool (10A, 10B, 10B) has a carrier (20) for attachment to an output (85) of the processing machine (80); wherein a cushion element (40A, 40B, 40C) made of elastic material and a retaining wall element (41A, 41B, 41C, 41D) for retaining the cushion element (40A, 40B, 40C, 61) are arranged on the carrier (20); wherein the retaining wall element (41A, 41B, 41C, 41D) is held on the carrier (20) by means of retaining bolts (35); wherein retaining bolt passage openings (48) of the retaining wall element (41A, 41B, 41C, 41D) extending through retaining mounts (28), of the carrier (20) are accommodated along bolt sections (36) of the retaining bolts (35) extending along the bolt longitudinal axes (BL), and the retaining wall element (41A, 41B, 41C, 41D) is held between bolt heads (37) of the retaining bolts (35) and the carrier (20); and wherein an adhesive layer (50) is arranged on a side of the retaining wall element (41A, 41B, 41C, 41D) opposite the carrier (20), on which adhesive layer a processing means (70) for grinding and/or polishing the workpiece (W) can be releasably attached to the disc tool (10A,
(Continued)

10B, 10B). The adhesive layer (50) has recesses (52) assigned to the bolt heads (37).

27 Claims, 6 Drawing Sheets

(58) Field of Classification Search
CPC ..... B24B 37/12; B24B 37/14; B24B 37/22; B24D 3/002; B24D 3/00; B24D 3/001; B24D 3/004; B24D 3/007; B24D 3/02; B24D 3/34; B24D 9/085; B24D 9/08; B24D 9/00; B24D 13/20; B24D 18/0045; B24D 2201/00; B24D 7/00; B24D 7/04; B24D 7/10; B24D 7/18; B24D 7/16
USPC ..... 451/329
See application file for complete search history.

(56) References Cited

U.S. PATENT DOCUMENTS 2,573,411 A 10/1951 Michel
4,631,220 A * 12/1986 Clifton ..... B24D 9/08 428/137
7,033,262 B2 4/2006 Takizawa et al.
2006/0019579 A1* 1/2006 Braunschweig ..... B24B 55/102 451/28
2008/0216272 A1* 9/2008 McLain ..... B24D 13/147 15/230.18
2008/0254726 A1* 10/2008 Catalfamo ..... B24B 23/02 451/548
2009/0191376 A1* 7/2009 Rivard ..... B24D 9/085 428/100
2013/0210325 A1* 8/2013 Schnyder ..... B24D 9/08 451/488
2014/0170940 A1* 6/2014 Yang ..... B24D 9/08 451/508
2019/0160622 A1* 5/2019 Barth ..... B24B 7/184
2020/0353593 A1 11/2020 Finnäs et al.

FOREIGN PATENT DOCUMENTS

DE 10 2015 113 190 A1 2/2017
DE 10 2020 105 572 A1 9/2021
GB 2 322 579 A 9/1998
WO 02/072313 A1 9/2002

* cited by examiner

DISC TOOL

BACKGROUND OF THE INVENTION

The invention relates to a disc tool for a processing machine, in particular a grinding machine or polishing machine, for grinding and/or polishing a workpiece; wherein the disc tool has a carrier for attachment to an output of the processing machine; wherein a cushion element made of elastic material, in particular foam, and a retaining wall element for retaining the cushion element are arranged on the carrier; wherein the retaining wall element and in particular the cushion element are retained on the carrier by means of retaining bolts; wherein retaining bolt passage openings of the retaining wall element extending through retaining mounts, in particular screw mounts, of the carrier are accommodated along bolt sections of the retaining bolts extending along the bolt longitudinal axes, and the retaining wall element is held, in particular tensioned or clamped, between bolt heads of the retaining bolts and the carrier; and wherein an adhesive layer is arranged on a side of the retaining wall element opposite the carrier, on which adhesive layer a processing means for grinding and/or polishing the workpiece, in particular an abrasive means or polishing means, can be releasably attached to the disc tool.

Such a disc tool is described in patent application DE 10 2020 105 572, for example. In this disc tool, the retaining wall element has the adhesive layer, namely a VELCRO™ (hook and loop fastener) layer, to which an abrasive sheet, for example, can be fastened. The adhesive layer is uneven in the region of the bolt heads, with which the retaining wall element and the cushion element are attached to the carrier, which is rigid compared to the cushion element and retaining wall element, whereby, for example, there is increased wear of the processing means or abrasive sheet, and/or a processing quality of a workpiece processed with the disc tool suffers. The disc tool itself, in particular the adhesive layer thereof, is also subjected to greater load during operation and wears out more quickly. The problem occurs to a particular degree with a processing machine in the form of a grinding machine that drives the grinding disc to make eccentric or oscillating grinding movements, in which high shear forces or transverse loads occur transversely to the output axis of the processing machine. Furthermore, the problem is exacerbated when the grinding disc has larger diameters.

SUMMARY OF THE INVENTION

It is therefore the object of the present invention to provide an improved disc tool.

In order to achieve this object, a disc tool of the type mentioned at the outset provides for the adhesive layer to have recesses assigned to the bolt heads.

The recesses are advantageously present before the retaining bolts are screwed into the carrier.

A cross-section or mounting cross-section of the recesses for mounting the bolt heads is preferably larger than a cross-section or insertion cross-section of the retaining bolt passage openings provided for inserting the bolt sections of the retaining bolts.

The recesses advantageously extend around the retaining bolt passage openings, in particular radially around the retaining bolt passage openings with respect to the bolt longitudinal axes.

A method for producing a disc tool, which has the features in the preamble of claim 1 or the features mentioned above, provides for the following:

- producing the recesses assigned to the bolt heads in the adhesive layer;
- arranging the retaining wall element on the carrier after the recesses are produced;
- fastening the retaining wall element to the carrier by inserting the retaining bolts into the retaining mounts, wherein the bolt heads are arranged in the recesses; and
- fixing the retaining wall element between the bolt heads of the retaining bolts and the carrier, in particular tensioning the retaining wall element or clamping the retaining wall element between the bolt heads and the carrier.

The recesses advantageously extend around the retaining bolt passage openings, in particular radially around the retaining bolt passage openings with respect to the bolt longitudinal axes.

A cross-section or mounting cross-section of the recesses for mounting the bolt heads is preferably larger than a cross-section or insertion cross-section of the retaining bolt passage openings provided for inserting the bolt sections of the retaining bolts.

It is preferred if the cushion element is also attached to the carrier by arranging the retaining wall element on the carrier or in connection with the arrangement thereof on the carrier. Accordingly, the following is advantageous:

- arranging the cushion element with the retaining wall element on the carrier after the recesses are produced;
- fastening the cushion element on the carrier by inserting the retaining bolts into the retaining mounts, wherein the bolt heads are arranged in the recesses.

When the cushion element is sandwiched between the retaining wall element and the carrier, the following step is useful:

- tensioning the cushion element between the bolt heads of the retaining bolts and the carrier.

The retaining wall element is used to hold the cushion element, which can also be characterized as at least one cushion element. In any case, the at least one cushion element is arranged between the adhesive layer and the carrier.

Advantageously, the invention also provides for a processing machine, namely a grinding machine or a polishing machine, which has a disc tool of this type, wherein the processing machine has a drive for the disc tool, by means of which the disc tool can be driven to make a rotary and/or eccentric and/or oscillatory movement by the processing machine.

A basic concept of the present invention is that there are recesses in the adhesive layer in the region of the bolt heads. For example, this makes it possible for the bolt heads to displace the elastic material of the cushion element and/or the retaining wall element in the region of the recesses, for example by means of a corresponding compressive load on the retaining wall element. However, the ambient pressure that occurs, for example when dust is extracted through the disc tool and/or due to pressure exerted by the operator of the disc tool, has an effect on the adhesive layer due to the recesses such that it does not have any bulges, for example, or has bulges to a lesser extent, or has uneven surface sections.

The retaining wall element comprises, for example, a fabric, in particular a textile fabric, a film, or also composite materials, which comprises a combination of the aforementioned components, for example a retaining wall element which comprises a film and a fabric layer that are connected to one another, for example glued to one another.

The retaining wall element is advantageously flexible and/or more flexible than the carrier.

The disc tool carrier consists of a rigid material such as hard plastic, metal, or the like. The carrier can have rib structures, for example. In any case, the carrier is the preferably completely or essentially rigid component of the disc tool, while the retaining wall element and the at least one cushion element are flexible and adaptable compared to the carrier.

The bolt heads act on the retaining wall element. Due to the recesses on or in the adhesive layer, the bolt heads do not impede the mobility of the adhesive layer during operation of the processing machine or to a lesser extent than when there are no recesses. The adhesive layer as a whole can have floating mobility with respect to the carrier, for example, without the bolt heads forming imperfections or anchor points, so to speak, which would impede the mobility of the adhesive layer.

Retaining bolt passage openings are provided on the retaining wall element and advantageously on the cushion element for the bolt sections.

The bolt heads project laterally in front of the bolt sections, i.e. they have larger diameters or cross-sections than the bolt sections. A diameter or cross-section of the recesses is larger than a diameter or cross-section of a respective retaining bolt passage opening provided for inserting a bolt section of a retaining bolt.

The recesses comprise, for example, cutouts and/or depressions in the adhesive layer. The recesses are already present before the retaining bolts are attached to the adhesive layer, for example in that the adhesive layer and/or an adhesive layer element having the adhesive layer is provided with the cutouts or depressions before the retaining bolts are introduced and/or attached, for example by pressing, thermal deformation, machining, or the like.

It is advantageously provided that a central axis or a center of at least one recess is concentric with respect to the bolt longitudinal axis of the retaining bolt accommodated in the recess. However, it is also possible for the bolt longitudinal axis to be eccentric with respect to the central axis or the center of the recess.

It is preferred if at least one of the recesses or all recesses of the adhesive layer has or have an inner diameter that is at least as large as an outer diameter of a bolt head accommodated in the recess or larger than an outer diameter of a bolt head accommodated in the recess.

Furthermore, it is possible for a retaining bolt passage opening to be arranged in the interior of one of the recesses or all recesses of the adhesive layer, through which passage opening a respective bolt section of the bolt accommodated in the recess penetrates or can penetrate. Consequently, the recess extends around the retaining bolt passage opening, in particular in a ring shape.

The bolt sections of the retaining bolts pass through retaining bolt passage openings in the adhesive layer. The recesses extend around the retaining bolt passage openings. The retaining bolt passage openings can have a smaller inner cross-sectional area than the recesses. However, it is also possible for the recesses to have an inner cross-sectional area in which a respective bolt head can be completely accommodated, so that the recess simultaneously forms a retaining bolt passage opening for the bolt section of a retaining bolt.

The adhesive layer can have passage openings, in particular to provide the recesses, through which the bolt heads can penetrate the adhesive layer. Although the adhesive layer has an inner cross-section in the region of the recesses that is smaller than an external cross-section of the bolt head accommodated in the recess, it is still possible for the bolt head to slide past the adhesive layer during assembly or when screwed into the carrier, so that the bolt head is not supported on the adhesive layer in the fully assembled state and/or in the state in which it is retained on the carrier in the retaining wall element. Then the adhesive layer can even protrude in the direction of the bolt head.

It is also advantageous if at least one of the recesses or all recesses in the adhesive layer has or have a larger cross-section and/or diameter than the bolt heads, so that a space is advantageously available between an inner circumference of a respective recess and an outer circumference of the bolt head accommodated in the recess transverse to the bolt longitudinal axis thereof.

The adhesive layer preferably has less material thickness in the regions thereof which are arranged, in particular tensioned or compressed, between a respective bolt head and the carrier than in a region next to the respective bolt head. A material thickness of the adhesive layer is therefore preferably less in those regions that are arranged between bolt heads and carriers than in the other regions of the adhesive layer.

The adhesive layer can be arranged directly on the retaining wall element, so that the retaining wall element is processed by the aforementioned processing, so to speak.

However, it is also possible for the adhesive layer to be arranged on an adhesive layer element, which in turn is arranged on the retaining wall element. In this case, the adhesive layer element is provided with the recesses, for example with cutouts and/or depressions, before the retaining bolts are introduced. If the adhesive layer element is multi-layered and/or comprises several layers, the recesses assigned to the retaining bolts preferably extend through all layers of the adhesive layer element. It is possible for the recess to have different geometries, for example different cross-sectional areas, cross-sectional geometries, and/or cross-sectional surface areas, and/or the like, on at least two layers or plies of the adhesive layer element. Thus, a respective recess can have a larger cross-section or a larger cross-sectional surface area in the region of the adhesive layer than in a section that is arranged closer to the retaining wall element. It is advantageous if the recesses of the adhesive layer element are designed as passage openings with a passage cross-section through which the bolt heads can penetrate.

The adhesive layer element, together with the cushion element and the retaining wall element and optionally further layers or walls arranged on the adhesive layer element, in particular between the adhesive layer element and the carrier, preferably forms a cushion or pad, which can be fastened as a whole to the carrier using the retaining bolts and used to hold the processing means.

The disc tool has a processing side, on which the adhesive layer is arranged, and a machine side opposite the processing side, on which the disc tool can be connected to the processing machine. A tool mount is arranged there, for example.

An advantageous measure provides for a tool mount or a tool-mounting element having a tool mount to be arranged on the carrier, wherein the disc tool can be releasably connected to an output of the processing machine using the tool mount.

The cushion element consists, for example, of foam, rubber, or the like. The cushion element is designed, for example, as a so-called pad. It is possible for the cushion element to consist of different materials, for example layers of different foam materials.

At this point, it should be mentioned that the disc tool can also have at least two cushion elements, of which a first cushion element is tensioned or can be tensioned between the bolt heads and the carrier, while at least one second cushion element is arranged on a side of the retaining wall element facing away from the carrier. The at least one second cushion element is positioned closer to the adhesive layer and farther from the carrier than the first cushion element. The at least one second cushion element is arranged between the adhesive layer and the retaining wall element.

The cushion elements can be made of different materials, for example different foams. It is also possible that one cushion element consists of rubber or caoutchouc while another cushion element consists of foam.

The cushion elements are preferably superimposed in the manner of layers between the carrier and the adhesive layer. More than two cushion elements can easily be present. In this case, a cushion element, i.e. a first cushion element, is preferably arranged between the carrier and the retaining wall element or forms a part of the retaining wall element, while at least one second cushion element or several second cushion elements is or are arranged on a side of the retaining wall element facing away from the carrier.

The at least one second cushion element or further cushion elements preferably has or have passage openings for the bolt heads such that the bolt heads can penetrate this second cushion element without tensioning it against the carrier.

It is possible for at least one cushion element to be arranged on the side of the retaining wall element facing the carrier and/or on the side of the retaining wall element opposite the carrier or facing away from the carrier.

A single cushion element can thus be arranged between the retaining wall element and the carrier, for example the above-mentioned first cushion element. Furthermore, the retaining wall element may be interposed between a single cushion element and the carrier.

However, it is also possible for at least one cushion element to be arranged on respective opposite sides of the retaining wall element, i.e. for at least one cushion element to be present between the carrier and the retaining wall element and one between the retaining wall element and the adhesive layer.

A cushion element arranged between the carrier and the retaining wall element, referred to above as the first cushion element, is sometimes also referred to as a sandwich cushion element in the following description. A cushion element which is arranged on the retaining wall element on a side of the retaining wall element opposite the carrier is also referred to as an adhesive layer cushion element in the following description. This cushion element is, for example, the aforementioned second cushion element. However, if both variants of cushion elements or both possible arrangements of cushion elements with respect to the retaining wall element are meant, the term cushion element is generally used.

It is advantageous if the cushion element or one of the cushion elements is held on the carrier by the retaining wall element, so to speak.

A preferred embodiment provides that the cushion element is arranged as an intermediate layer between the carrier and the retaining wall element.

The bolt sections of the retaining bolts pass through the retaining wall element and the cushion element, for example.

It is advantageous in this case if the cushion element and/or the retaining wall element is compressed between the bolt heads of the retaining bolts and the carrier. In any case, in this embodiment, the cushion element can be compressed by the bolt heads. Due to the displacement of the cushion element and/or the retaining wall element by the bolt heads, it is possible for components of the cushion element and/or the retaining wall element to protrude laterally in front of the bolt heads, so to speak.

It is advantageously provided that the retaining wall element consists of a material with a higher tensile strength than the cushion element.

The retaining wall element consists, for example, of a textile fabric, a nonwoven, a VELCRO™ (hook and loop fastener) layer, or the like. The retaining wall element tensions the cushion element against the carrier, so to speak. The retaining wall element is loaded by the bolt heads in the sense of a compression of the cushion element, so that material of the cushion element located next to the bolt heads is also subjected to a force in the direction of the carrier.

In a preferred embodiment, the retaining bolts are screw bolts which can be screwed into the retaining mounts of the carrier, which are embodied as screw mounts. However, bayonet contours, for example, on the retaining mounts and the bolt sections, which can be brought into engagement with one another, are also possible. However, the retaining bolts can also be designed, for example, as rivet elements, tie rods, or similar components with which the retaining wall element and optionally the cushion element can be tensioned in the direction of the carrier. Furthermore, the retaining bolts can, for example, have clamping contours and/or gripping contours, for example Christmas tree contours, on their bolt sections for clamping engagement and/or gripping engagement from behind with the retaining mounts.

It is preferred if the cushion element and the retaining wall element can be detachably fastened to the carrier. For example, the retaining bolts can be actuated using an assembly tool, for example a screwdriver, and accordingly have the actuating contours, in particular on the bolt heads thereof. Thus, if necessary, for example when it is worn out, the cushion element can easily be dismantled from the carrier and another cushion element that is not worn can be mounted.

The carrier is preferably plate-like or disc-like. The carrier preferably supports the cushion element over the entire surface thereof. In principle, however, it is possible for the cushion element to protrude over an outer circumference of the carrier or to be set back behind an outer circumference of the carrier.

It is also advantageous if the retaining wall element completely covers the cushion element on its side facing the adhesive layer when the cushion element is arranged between the retaining wall element and the carrier. When the retaining wall element is arranged between the cushion element and the adhesive layer, it advantageously completely covers the carrier-facing side of the cushion element.

The disc tool preferably has a circular outer circumference or a circular outer circumferential contour. However, the disc tool can also easily have an elliptical or other non-round outer circumferential contour. Furthermore, the disc tool can have a polygonal outer circumferential contour, for example a triangular or rectangular outer circumferential contour.

It is advantageously provided that the carrier and/or the cushion element and/or the sandwich cushion element and/or the retaining wall element and/or the components to be explained below, for example an intermediate wall element and/or an adhesive layer cushion element and/or an adhesive layer element which has the adhesive layer, have identical or essentially the same outer circumferential contours.

The disc tool is advantageously provided with at least one flow-passage channel for air, which has inflow openings on the adhesive layer and outflow openings on the carrier, wherein air can flow through the at least one flow-passage channel from the adhesive layer in the direction of the carrier or, vice versa, from the carrier in the direction of the adhesive layer. Thus, for example, air laden with dust or particles can be extracted through the disc tool. The at least one flow-passage channel or flow-passage channels preferably penetrates or penetrate all of the layers and/or plies of the disc tool. Outflow openings are advantageously arranged on the machine side of the disc tool, for example on the side of the carrier facing away from the processing side. It is preferred if a number of flow-passage channels are arranged in a ring around the tool mount.

It is possible for the bolt head or bolt heads to be flush with the adhesive layer. It is preferred if the bolt head or bolt heads do not protrude in front of the adhesive layer in the direction of the processing means. It is also advantageous if the bolt head or bolt heads are arranged behind a plane into which the adhesive layer extends. Thus, in the plane of the adhesive layer, there are regions, in particular around the bolt heads, at which the processing means is not or cannot be supported on the adhesive layer and/or on the bolt heads.

Advantageously, the disc tool provides that a component of the retaining wall element and/or the cushion element displaced by the bolt head does not protrude in front of the adhesive layer, for example is aligned flush with the adhesive layer or is advantageously arranged behind the adhesive layer.

It is preferred if at least one of the recesses or all recesses in the adhesive layer has or have a larger cross-section and/or a larger diameter than the bolt heads, so that a space is available between an inner circumference of a respective recess and an outer circumference of the bolt head accommodated in the recess, transverse to the bolt longitudinal axis thereof. Thus, for example, there is an annular space, transverse to the bolt longitudinal axis, around the respective bolt head between the outer circumference thereof and the inner circumference of the recess.

It is advantageously provided for at least one of the recesses or all recesses to form a displacement cavity into which components of the retaining wall element and/or the cushion element displaced by a respective bolt head can be displaced or are displaced.

A preferred concept provides that at least one of the recesses or all recesses is or are formed and/or designed to accommodate a bulge of the cushion element and/or the retaining wall element formed by the respective bolt head. For example, if a respective bolt head displaces the cushion element or retaining wall element in such a way, in particular due to direct loading of the cushion element or the retaining wall element or also due to loading of the retaining wall element acting on the cushion element, that a kind of bulge or similar arch is formed in the direction of the adhesive layer, this bulge or arch can be accommodated in the displacement cavity. The adhesive layer thus forms a contact surface for the processing means, for example the abrasive means, which is essentially flat and/or does not have any arching produced by a material displaced by a respective bolt head and protruding in the direction of the processing means.

In the region of the recess, the adhesive layer can be completely interrupted or omitted. Consequently, the adhesive layer can have a hole or a passage opening, so to speak, in the region of the recess.

It is also possible that the adhesive layer has only a reduced material thickness or height in the region of the recess, i.e. that the recess is a depression in the adhesive layer or comprises a depression in the adhesive layer.

It is possible for a respective recess to have a single depth with respect to the adhesive layer. For example, the recess can have a flat bottom for accommodating the bolt head, and at least one of the recesses or all recesses is or are deeper in a region radially closer to the bolt longitudinal axis of the retaining bolt accommodated therein with respect to the adhesive layer than in a region further away radially from the bolt longitudinal axis.

One embodiment can provide that the cushion element is supported directly on the carrier.

A connecting wall element is advantageously arranged between the cushion element and the carrier. The connecting wall element preferably forms a thinner layer than the cushion element. The connecting wall element can easily be another, in particular thin, cushion element.

It is possible that the connecting wall element only serves as a kind of buffer and cannot withstand higher mechanical loads than, for example, the cushion element. However, it is preferred if the connecting wall element consists of a material with a higher tensile strength than the elastic material of the cushion element.

The connecting wall element and/or the retaining wall element and/or the adhesive layer wall, which will be explained below, and/or the intermediate wall element, which will also be explained, consist, for example, of a nonwoven material, velour, a textile fabric, a film material, a polishing means material, a VELCRO™ (hook and loop fastener) material, or the like.

It is advantageous if the adhesive layer completely or essentially completely covers a side of the disc tool facing away from the carrier, wherein, however, openings can be present, namely, for example, flow-passage openings for air, in particular for extracting dust and/or an opening is provided for fastening the disc tool on an output of the processing machine, for example for a screw with which the disc tool can be screwed to the processing machine.

The adhesive layer preferably covers at least 80%, preferably at least 85% or 90%, of the side of the disc tool facing away from the carrier.

It is preferably provided that the cushion element and the retaining wall element and/or the cushion element and the connecting wall element form a sandwich-like connected unit or a composite element. The recesses are preferably provided or produced on this unit or the composite element, for example by the thermal and/or machining and/or abrasive and/or cutting and/or embossing process explained below.

Furthermore, this composite element also has the flow-passage openings or flow-passage channels for air, for example for extracted air laden with particles and/or for air that can flow out of the disc tool on the processing side of the disc tool when it is operated with the processing machine. The advantage can be seen in the fact that the composite element can be inserted into a punching tool, for example, in order to punch the flow-passage openings or flow-passage channels. In this way or with this punching tool, retaining bolt passage openings provided for the retaining bolts can also be punched. Thus, the passage openings for the retaining bolts and the flow-passage openings or flow-passage channels can be produced in a single machining process. The disc tool can be held in a tool mount in which it can optionally remain in order to carry out subsequent processing steps, for example the processing steps explained below. However, these processing steps can also be carried out if a further tool mount is used for holding the disc tool or one of the components thereof.

An advantageous measure provides that the recesses are formed by a thermal and/or machining and/or abrasive and/or cutting and/or pressure-loading and/or embossing process that reduces a material thickness of the adhesive layer and/or an adhesive layer element having the adhesive layer.

For example, it is provided that hooks present on the adhesive layer, in particular VELCRO™ hooks, are plastically deformed and/or melted by thermal processing, so that they do not protrude as far in the direction of the processing side of the disc tool facing away from the carrier. However, it is also possible to use a grinding tool or a machining tool, for example a milling tool, to process the adhesive layer or the adhesive layer element in order to form the recess. Finally, it is also possible for the recess to be cut out or punched out partially or as a whole from the adhesive layer, for example using a punching tool or other similar cutting tool.

In the case of the disc tool, it is advantageously provided that it has an adhesive layer element which has an adhesive layer wall with the adhesive layer and is arranged on the retaining wall element.

The adhesive layer element can have several plies or layers, as will become clearer below. However, it is also possible for the adhesive layer element, so to speak, to comprise only a single ply or layer, for example having only the adhesive layer. Consequently, the adhesive layer element forms, for example, an additional single or multi-ply layer which is present on a side of the cushion element facing away from the carrier, in addition to the retaining wall element.

It is advantageously provided with the disc tool that the adhesive layer element is held on the retaining wall element in a material and/or form-fitting manner. For example, it is possible for the retaining wall element to have a hook arrangement and/or VELCRO™ hooks for holding the adhesive layer element. Additional bonding creates a material connection between the retaining wall element and the adhesive layer element.

An advantageous measure provides that the adhesive layer element has an adhesive layer cushion element made of an elastic material, in particular foam, arranged between the adhesive layer wall and the retaining wall element.

It is possible for the cushion element, as already discussed, to be arranged between the adhesive layer wall and the retaining wall element. This cushion element can be the only cushion element of the disc tool and form the adhesive layer cushion element in this case.

However, the disc tool can also have the already mentioned sandwich cushion element and additionally the adhesive layer cushion element. Further cushion elements are easily possible.

It is advantageous if the adhesive layer cushion element has passage openings through which the bolt heads pass. It is advantageous if the bolt heads can be freely inserted or are inserted through these passage openings.

It is also advantageous if the adhesive layer cushion element is not tensioned against the carrier by the bolt heads and/or is not loaded, in particular directly loaded, by the bolt heads.

An advantageous concept provides that the adhesive layer cushion element is arranged on the adhesive layer element on a side facing away from the bolt heads.

The cushion elements of the disc tool, for example the adhesive layer cushion element and the previously discussed cushion element located between the carrier and the retaining wall element, can consist of different or the same materials, for example rubber, foam, or the like.

Advantageously, the disc tool provides for the adhesive layer element to have an intermediate wall element which is arranged between the adhesive layer cushion element and the retaining wall element and is connected to the retaining wall element, in particular is materially connected. The intermediate wall element is preferably made of a material that has a higher tensile strength than the adhesive layer cushion element, for example a textile material, nonwoven material, velour, or the like. The intermediate wall element and the connecting wall element can consist of the same material.

It is preferred if the intermediate wall element and the retaining wall element are held together in a form-fitting and/or material-fitting and/or force-fitting and/or surface-fitting manner. For example, the intermediate wall element and the retaining wall element can be connected to one another using a VELCRO™ (hook and loop fastener) connection. Gluing or another similar material connection, which is provided as an alternative or in addition to the form-fitting connection or VELCRO™ (hook and loop fastener) connection, is also readily possible for connecting the intermediate wall element and retaining wall element.

An advantageous measure provides that the adhesive layer cushion element and the intermediate wall element and/or the adhesive layer wall form a sandwich-like connected unit or an adhesive layer composite element on which the recesses are formed. The same measures that can be provided for the composite element already mentioned, which has the cushion element arranged closer to the carrier, can also be provided for the adhesive layer composite element, for example flow-passage openings or flow-passage channels for air, for example for extracted air laden with particles and/or for air which can flow out of the disc tool on the processing side of the disc tool when it is operated with the processing machine.

It is possible for the recesses to comprise passage openings on the adhesive layer or to be formed thereby, it being possible for the bolt heads to thereby completely penetrate the adhesive layer. It is therefore advantageous if the bolt heads are not supported on the adhesive layer.

The passage openings have, for example, an insertion cross-section that is larger than a cross-section of the bolt heads, so that the bolt heads can easily penetrate the passage openings.

However, it is also possible for the passage openings to have a smaller diameter than the bolt heads and for slots on the adhesive layer to extend radially outwards from the passage openings. Thus, the material of the adhesive layer can be displaced from the bolt heads when the bolt heads penetrate the adhesive layer.

It can be provided that the retaining wall element directly forms the adhesive layer element.

In the case of the disc tool, it is advantageously provided that the adhesive layer is arranged on the retaining wall element and/or the retaining wall element integrally comprises the adhesive layer.

A preferred concept provides that the adhesive layer has a VELCRO™ (hook and loop fastener layer with VELCRO™ hooks for holding the processing means.

The adhesive layer and the cushion element advantageously consist of materials different from one another or are different layers. For example, the cushion element consists of foam or rubber, while the adhesive layer is preferably formed by a separate body that has a different material than the cushion element, i.e., it does not consist of foam and rubber, for example.

The retaining wall element advantageously has retaining bolt passage openings for the bolt sections of the retaining bolts, from which passage openings slots extend radially away, so that a region of the retaining wall element surrounding a respective retaining bolt passage opening is segmented. The slots can be produced, for example cut or punched, for example in connection with the production of the flow-passage openings or flow-passage channels and/or the retaining bolt passage openings. It is particularly preferred if the slots are produced on the composite element having the retaining wall element and the cushion element.

In the case of the disc tool, it is advantageously provided that the processing means is an abrasive sheet. It is also possible that the processing means is or comprises, for example, a knitted fabric, a nonwoven, a polishing fabric, or the like.

The disc tool can comprise the processing means, for example the abrasive sheet.

BRIEF DESCRIPTION OF THE DRAWINGS

Exemplary embodiments of the invention are explained below with reference to the drawing. The following is shown in the figures.

DETAILED DESCRIPTION

Figure 1:
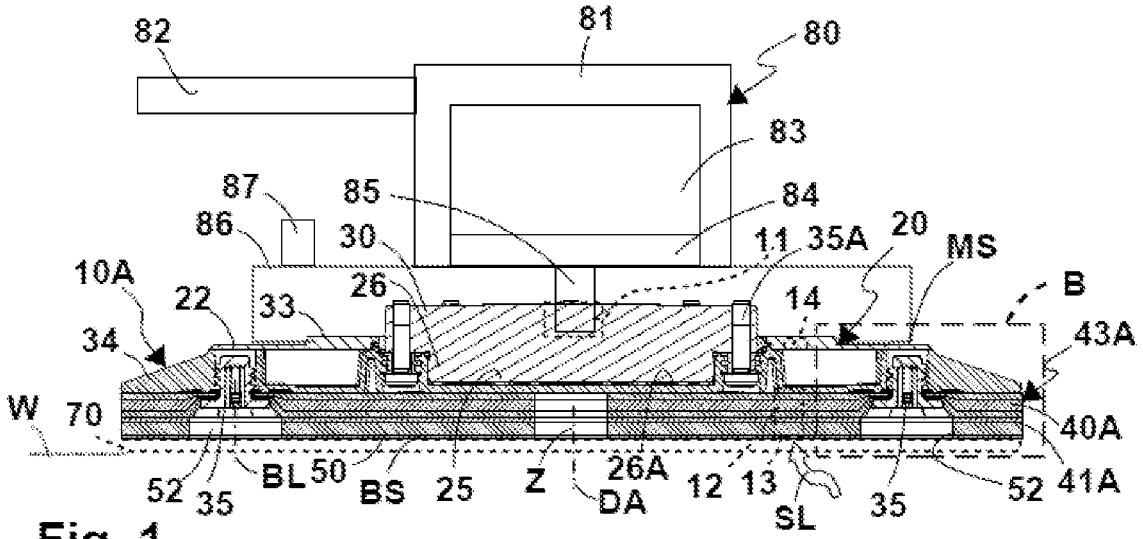
FIG. 1 a schematic view of a processing machine and a sectional view of a disc tool arranged on the processing machine approximately along a section line A-A; which is shown in FIG. 2 which shows a cushion element and an adhesive layer element of the disc tool according to FIG. 1 in a perspective view from the processing side thereof.

A processing machine 80 is, for example, a grinding machine and/or a polishing machine. The processing machine 80 has, for example, a housing 81 from which a handle 82 protrudes, which can be gripped by an operator. The handle 82 can be a short handle.

Preferably, the handle 82 is designed as an elongated handle bar, on one end region of which a handle for grasping by an operator is arranged and on the other end region of which the housing 81 is arranged, so that a ceiling or a wall, for example, can be processed. For example, the processing machine 80 is a so-called long-neck grinder.

An electric and/or pneumatic drive motor 83 is arranged in the housing 81 and drives an output 85 via a gear 84, for example in a rotary and/or eccentric and/or oscillating manner. Corresponding oscillating and/or eccentric and/or rotary driving gears 84 are known. The output 85 forms a tool mount and is arranged in an extraction housing 86.

Disc tools 10A, 10B, and 10C explained below are optimally adapted to operation with the processing machine 80 because they can withstand the forces and loads generated by the output 85 that are necessary, for example, for grinding or polishing a workpiece W using the disc tools 10A, 10B, 10C.

Insofar as the disc tools 10A, 10B, 10C have the same or similar components, they are provided with the same reference symbols in the following description. Wherever possible, similar components are provided with the same numbers, which, however, are provided with additional letters A, B, and C for assignment to the respective disc tool 10A, 10B, 10C. When all disc tools 10A, 10B, 10C are meant, they are referred to generically as disc tools 10.

The disc tools 10 each have a tool mount 11 which can be fastened to the output 85. The tool mount 11 can, for example, be a bayonet tool mount with bayonet contours for fastening the output 85. It is also possible that the tool mount 11 has, for example, a screw mount or passage opening for a fastening screw arranged on the output 85. In any case, the disc tools 10 can be detachably fastened to the output 85 using the tool mounts 11.

The tool mounts 11 are arranged on a machine side MS of the disc tools 10 provided for attachment to the processing machine 80. A processing side BS, which is opposite the machine side MS, is used to process the workpiece W.

The tool mounts 11 are located in a center Z of the disc tools 10 through which an axis DA passes. The axis DA passes through the disc tools 10 vertically from the machine side MS to the processing side B. The axis DA can, for example, be an axis of rotation about which the disc tool can be driven in a rotary manner when a respective disc tool 10 is used on the processing machine 80. The axis DA passes through a center Z of a respective disc tool 10.

The disc tools 10 are, for example, essentially circular.

Furthermore, the disc tools 10 have flow-passage channels 12 that extend from the processing side BS to the machine side MS and have inflow openings 13 on the processing side BS, which are fluidically connected to outflow openings 14 on the machine side MS. The outflow openings 14 are arranged in the extraction housing 86 when the disc tool 10 is mounted on the processing machine 80. Thus, dust-laden air SL can flow through a respective disc tool 10 in the direction of the machine side MS via the inflow openings 13, where the dust-laden air SL flows into the extraction housing 86. An extraction connection 87 communicates with the extraction housing 86, to which, for example, an extraction hose of a vacuum cleaner can be connected.

The outflow openings 14 can be arranged on a cover 33 of the carrier 20 which provides or has the wall surface 22 in whole or in part and with which a base body 34 of the carrier 20 is covered on the machine side MS. The cover 33 covers, for example, the channel structures of the flow-passage channels 12 that can be seen in FIG. 10, either completely or partially on the machine side MS.

The disc tools 10 have carriers 20. The carriers 20 are, for example, plate-like. The carriers 20 have the same structure for all disc tools 10, so that one carrier 20 is explained in the following description.

The carrier 20 has a mounting surface 21, which is assigned to the processing side BS, and a wall surface 22 opposite the mounting surface 21, which is at least partially covered by the extraction housing 86 when the disc tool 10 is arranged on the processing machine 80. The outflow openings 14 are arranged in a ring around the center Z on a radially inner part of the wall surface 22.

Inflow openings 23 are provided on the mounting surface 21, through which inflow openings dust-laden air SL can flow into the carrier 20 and to the outflow openings 14. The inflow openings 23 are arranged in a ring around a center Z or in a ring around the tool mount 11. Furthermore, the inflow openings 23 extend radially inwards in the direction of the center Z of the carrier 20 or in the direction of the tool mount 11, so that dust-laden air SL can also be extracted radially inwards with respect to an outer circumference 24 of the carrier 20.

It is then possible in principle for the carrier 20 to have the tool mount 11 integrally. In the present case, however, there is a multi-part design, i.e. the carrier 20 has a mount 25 for a tool-mounting element 30 on which the tool mount 11 is arranged. The mount 25 has, for example, an insertion opening 26 that extends from the machine side to the processing side BS and from which the retaining mounts 27 extend radially outward like fingers. A base body 31 of the tool-mounting element 30 is accommodated in the insertion opening 26 and rests, for example, on the base 26A thereof or opposite the base 26A. Fastening arms 32 protrude radially outwards from the base body 31 with respect to the axis DA and engage the retaining mounts 27 in a form-fitting manner. The fastening arms 32 are bolted to the carrier 20 using screws 32A.

Retaining mounts 28 in the form of screw mounts 29 are provided on the mounting surface 21, with which screw mounts the further components of disc tools 10A, 10B, and 10C explained below can be attached or are attached to the respective carrier 20. Each screw mount 29 has a screw thread 29A, for example. Bolt sections 36 of retaining bolts 35 with the screw threads 36A thereof can be screwed into the screw mount 29 or unscrewed from the screw mount 29. For example, actuation contours 38, for example slots, cross-slots, or the like, are provided on the bolt heads 37, which slots can be actuated using an assembly tool, in particular a screwdriver. Thus, the cushion elements 40A, 40B, 40C can be releasably attached to the carrier 20.

Bolt heads 37 of the retaining bolts 35 then support the further components of the disc tools 10 on the mounting surface 21 as explained below, in particular in terms of tensioning these further components with the mounting surface 21, so that they are firmly held on the respective carrier 20.

The disc tools 10A, 10B, 10C have cushion elements 40A, 40B, 40C on the processing sides BS thereof.

Each cushion element 40A, 40B, 40C is sandwiched between a retaining wall element 41A, 41B, 41C and a connecting wall element 42, for example. Thus, the cushion elements 40A, 40B, 40C can also be referred to as sandwich cushion elements.

The cushion elements 40A, 40B, 40C consist, for example, of rubber, foam, or other similar elastic material. For the cushion elements 40A, 40B, 40C, the retaining wall elements 41A, 41B, 41C and the connecting wall elements 42 are, so to speak, laminations or covers which ensure a uniform introduction of force onto a respective cushion element 40A, 40B, 40C.

For example, the connecting wall elements 42 and the retaining wall elements 41A, 41B, 41C consist of a textile material, a fabric, in particular a textile fabric, a knitted fabric, a nonwoven, velour, or the like.

In any case, at least the retaining wall element 41A, 41B, 41C consists of a material that has a higher tensile strength than the cushion element 40A, 40B, 40C.

The connecting wall element 41A, 41B, 41C preferably also consists of a material that has a higher tensile strength than the cushion elements 40A, 40B, 40C.

It is also possible for the retaining wall element 41A, 41B, 41C and/or the connecting wall element 42 to consist of a VELCRO™ (hook and loop fastener) fabric which has VELCRO™ hooks.

The cushion elements 40A, 40B, 40C are firmly connected to the retaining wall elements 41A, 41B, 41C and the connecting wall elements 42, so that composite elements 43A, 43B, 43C are formed. For example, the cushion elements 40A, 40B, 40C, the retaining wall elements 41A, 41B, 41C, and the connecting wall elements 42 are welded, glued, or similarly connected to one another in a material connection. A form-fitting connection, which can be provided in addition to the material-fitting connection or as an alternative to the material-fitting connection, is easily possible between the cushion element 40A, 40B, 40C and the retaining wall element 41A, 41B, 41C and the connecting wall element 42 of a respective composite element 43A, 43B, 43C.

The composite elements 43A, 43B, 43C are attached to the carriers 20 as a whole by means of the retaining bolts 35. The retaining bolts 35, with the bolt sections 36 thereof, penetrate retaining bolt passage openings 48 which are flush with the retaining mounts 28 of the carrier 20 when a respective composite element 43A, 43B, 43C is attached to the carrier 20. Consequently, retaining bolt passage openings 48 are arranged in a ring around the axis DA or a center Z of a respective cushion element 40A, 40B, 40C.

The composite elements 43A, 43B, 43C and thus the components thereof, namely the cushion element 40A, 40B, 40C, the retaining wall element 41A, 41B, 41C, and the connecting wall element 42, have flow-passage openings or flow-passage channels 45, which form components of flow-passage channels 12. The flow-passage openings or flow-passage channels 45 are flush with the inflow openings 23 on the wall surface 22 of the carrier 20. For example, flow-passage openings or flow-passage channels 45 arranged radially with respect to the axis DA and/or flow-passage openings or flow-passage channels 45 arranged annularly along an outer circumference 44 are provided.

The retaining wall elements 41A, 41B, 41C serve to support an adhesive layer 50 to which a processing means 70 can be attached. The processing means 70, for example, is an abrasive sheet 71, which can be attached to the adhesive layer 50 with a mounting side 72 and has a processing side 73, which is opposite the mounting side 72 and has a material suitable for processing the workpiece W, for example a grain, a nonwoven, or the like. The mounting side 72 has, for example, a loop fabric which is suitable for producing a VELCRO™ (hook and loop fastener) connection with VELCRO™ hooks 51 of the adhesive layer 50.

The processing means 70, for example the abrasive sheets 71, have flow-passage openings or flow-passage channels 75 that correspond to the inflow openings 13 or the flow-passage openings or the flow-passage channels 45 and are flush thereto when mounted on the disc tool 10, so that dust-laden air can flow from the processing side 73 to the mounting side 72 and into the inflow openings 13.

In the case of disc tool 10B, the adhesive layer 50 is arranged directly on the retaining wall element 41B. Consequently, the retaining wall element 41B forms an adhesive layer element 60B.

In the case of disc tools 10A and 10C, adhesive layer elements 60A, 60C are provided which are separate from the retaining wall elements 41A, 41C and have the adhesive layer 50.

The adhesive layer element 60A has an adhesive layer cushion element 61 sandwiched between an intermediate wall element 62 and an adhesive layer wall 63A. The adhesive layer cushion element 61, together with the adhesive layer wall 63A and the intermediate wall element 62, forms an adhesive layer composite element 64; the components thereof which are the adhesive layer wall 63A, the cushion element 61, and the intermediate wall element 62 are firmly connected to one another, for example glued together.

The adhesive layer cushion element 61 is made of an elastic, resilient material such as foam, rubber, or the like.

Similar to the composite element 43A, 43B, 43C, the adhesive layer composite element 64 has the adhesive layer cushion element 61 reinforced or laminated by the outer components of the adhesive layer composite element 64, namely the intermediate wall element 62 and the adhesive layer wall 63A, because the intermediate wall element 62 and the adhesive layer wall 63A consist, for example, of a material that has a higher tensile strength than the material of the adhesive layer cushion element 61, for example a woven fabric, a knitted fabric, a nonwoven, or the like.

The adhesive layer 50 is arranged on the adhesive layer wall 63A. The adhesive layer 50 also has VELCRO™ hooks 51 in the adhesive layer element 60A, which, however, are not shown in the drawing for reasons of simplification.

The adhesive layer element 60C consists only of an adhesive layer wall 63C, which is arranged directly on the retaining wall element 41C, for example glued thereto. The adhesive layer wall 63C supports the adhesive layer 50 or has the adhesive layer 50, i.e. it is provided with the VELCRO™ hooks 51, for example (which is not shown in the drawing).

Adhesive layer elements 60A and 60C are firmly connected to the retaining wall element 41A, 41C, for example glued and/or form-fittingly connected.

For example, a combination of form-fitting and material-fitting connection is advantageous. For example, the intermediate wall element 62 and the retaining wall element 41A can be designed to produce a VELCRO™ (hook and loop fastener) connection, wherein, for example, a VELCRO™ hooks are present on the retaining wall element 41A and associated loops are on the intermediate wall element 62 or vice versa. Additional gluing, welding, or the like of the intermediate wall element 62 and the retaining wall element 41A ensures a material-fitting, firm, and thus shear-resistant connection between the two composite elements 43A and 64, transversely to axis DA.

Figure 13:
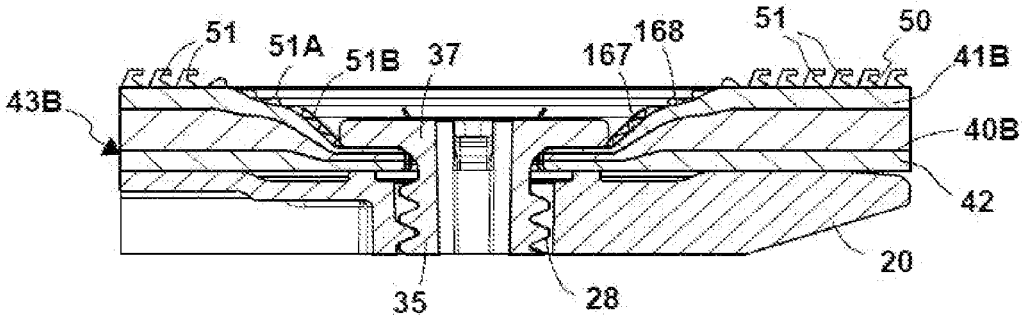
FIG. 13 a partial section of the disc tool according to FIG. 6, approximately corresponding to section D, wherein VELCRO™ hooks of the adhesive layer are shown.

The adhesive layer element 60C has, for example, a VELCRO™ (hook and loop fastener) layer or VELCRO™ hooks in the manner of the VELCRO™ hooks 51 according to FIG. 13, wherein this not shown for reasons of simplification in the case of adhesive layer element 60C.

The retaining wall elements 41A, 41B, 41C can be loaded by the bolt heads 37 when the retaining bolts 35 are screwed into the retaining mounts 28 in such a way that they tension and compress the cushion elements 40A, 40B, 40C in the direction of the carrier 20. The retaining wall elements 41A, 41B, 41C form funnel-shaped or conical wall sections 141 next to the bolt heads 37, which wall sections extend annularly around the bolt longitudinal axes BL of the retaining bolts 35 and/or the retaining bolt passage openings 48. Close to the respective bolt head 37, thus the material of the cushion element 40A, 40B, 40C is almost completely displaced in the direction of the carrier 20 or the mounting surface 21, while the force exerted onto the retaining wall element 41A, 41B, 41C and thus onto the cushion element 40A, 40B, 40C by the bolt head 37 is less at a greater radial distance from the bolt longitudinal axis BL of a respective retaining bolt 35 or the retaining bolt passage openings 48.

Figure 11:
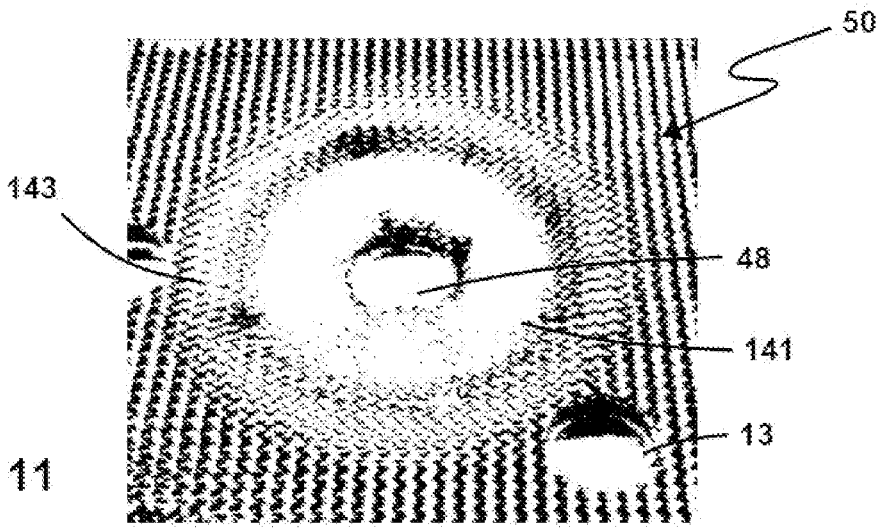
FIG. 11 a section of an adhesive layer of a disc tool with signs of wear, approximately corresponding to a section G in FIG. 8.
Figure 12:
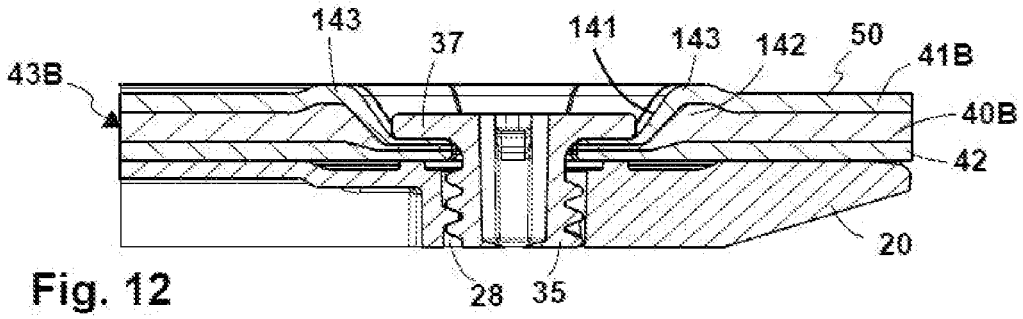
FIG. 12 a partial section of a disc tool having the adhesive layer according to FIG. 11, approximately corresponding to the section according to FIG. 6, wherein the adhesive layer is unprocessed.

FIGS. 11, 12 show a situation which arises without the measures, which are still to be explained. In addition to the funnel-shaped section 141, material of the cushion element 40B displaced by the retaining wall element 41B and/or the retaining wall element 41B itself forms a bulge 142, which is generated by the application of force by the bolt head 37. This bulge 142 also forms a bulge 143 on the adhesive layer 50 or on the retaining wall element 41B so that the adhesive layer 50 also has an unevenness. Both the adhesive layer 50 and the processing means 70 or abrasive sheet 71 arranged thereon are thus subjected to greater pressure in the direction of the workpiece W by the bulge 143, so that greater abrasion or more wear takes place, which can be seen in FIG. 11.

It is advantageously provided that the retaining wall element 41, as shown by way of example on retaining wall element 41A, has slots 49 which extend radially outwards and/or in a star shape around the retaining bolt passage openings 48. The retaining wall element 41 adapts to the contour of the bolt heads 37 through the slots 49.

Such a bulge is avoided by the measures explained below, or the effect thereof is at least reduced in such a way that the adhesive layer 50 does not have a contour protruding towards the processing means 70 in the region and/or the vicinity of the bolt heads 37 of the retaining bolts 35, but at most a depression is present, so that the unevenness or ring-shaped characteristics of the adhesive layer 50 shown in FIG. 11 are avoided.

For this purpose, a recess 52 is provided in the adhesive layer 50 in the region and/or in the vicinity of the bolt heads 37.

Figure 6:
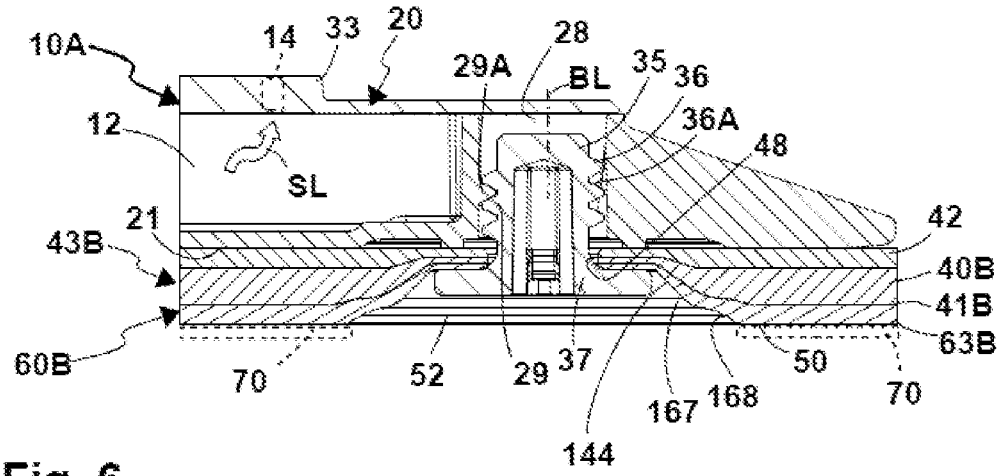
FIG. 6 a section D of FIG. 4.
Figure 7:
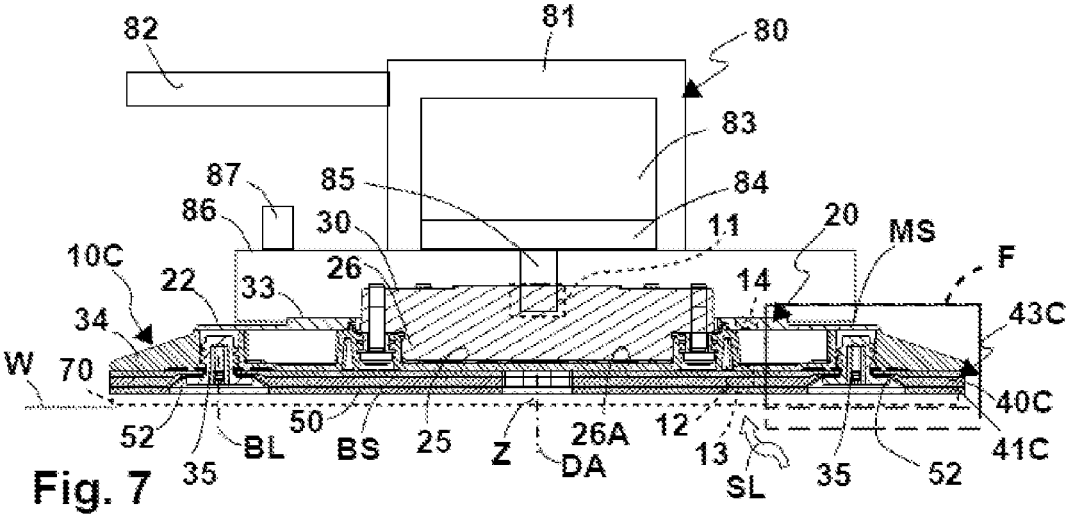
FIG. 7 a sectional view of a third disc tool that can be operated with the processing machine according to FIGS. 1 and 4, approximately along a section line E-E; which is shown in FIG. 8 which shows a cushion element with an adhesive layer the disc tool according to FIG. 7 in a perspective view from the processing side thereof.
Figure 8:
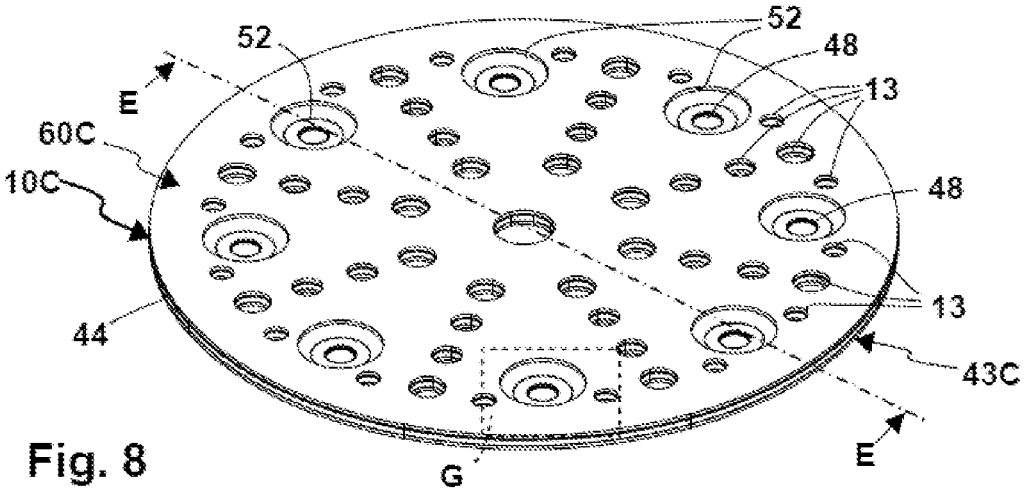
Figure 9:
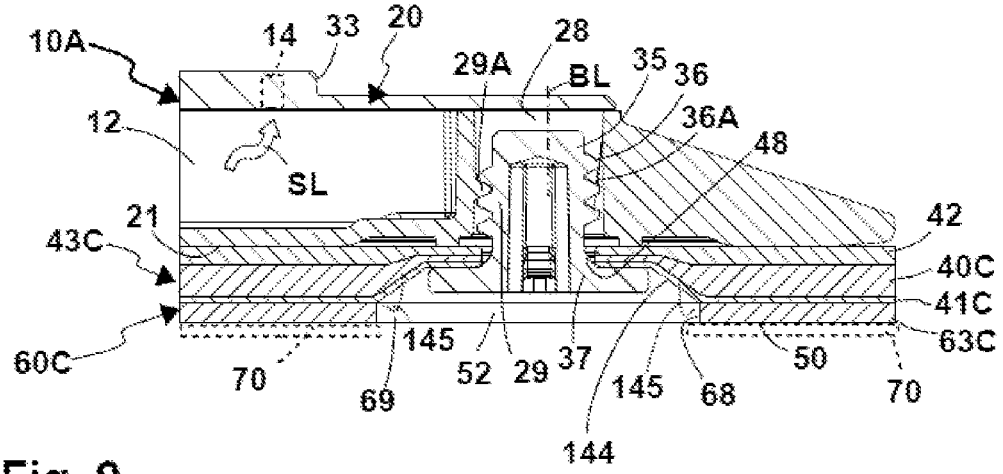
FIG. 9 a section F of FIG. 7.

The recesses 52 have cross-sections Q52 which are larger than the cross-sections Q48 of the retaining bolt passage openings 48. The cross-sections Q52 are provided for mounting the bolt heads 37. A cross-section Q52 is at least large enough for the bolt head 52 to be fully accommodated in the respective recess 52. It is also possible, for example according to FIG. 6, that a cross-section Q52A is provided for a recess 52, which cross-section is greater than the cross-section of the bolt head 37 accommodated in the recess 52.

The bolt sections 36 of the retaining bolts 35 pass through retaining bolt passage openings 53 of the adhesive layer 50. The recesses 52 extend around the retaining bolt passage openings 53. As will become clear, the retaining bolt passage openings 53 can have a smaller inner cross-sectional area than the recesses 52. However, it is also possible for the recesses 52 to have an inner cross-sectional area in which a respective bolt head 37 can be completely accommodated, so that the recess 52 at the same time forms a retaining bolt passage opening 53 for the bolt section 36 of a retaining bolt 35.

In the case of adhesive layer element 60A, it is provided that each layer, namely the adhesive layer 50, the adhesive layer wall 63A, the adhesive layer cushion element 61, and the intermediate wall element 62, have passage openings 66, 67, and 68. Passage openings 66, 67, and 68 advantageously have a larger cross-section and/or diameter than a depression 144 which results from the tensioning of the retaining wall element 41A and thus the compression of the cushion element 40A by the bolt heads 37. It is also possible for passage openings 66, 67, and 68 to have a cross-section and/or diameter that is at least as large as that of the depression 144.

The depressions 144 are, for example, funnel-shaped.

If a bulge 145 in the manner of bulge 142 or 143 forms on the circumferential edge of a respective depression 144, which is shown schematically in the drawing, this bulge 145 can be on the inner circumference of the recess 52, for example on the inner circumference of the layers of the adhesive layer composite element 64 that are spaced apart from the adhesive layer 50, for example on the inner circumference of passage openings 68 and/or 67. Thus, passage openings 66, 67, and 68 and in any case the recess 52 form an expansion cavity or displacement cavity 69 for the material of the cushion element 40A.

Figure 2:
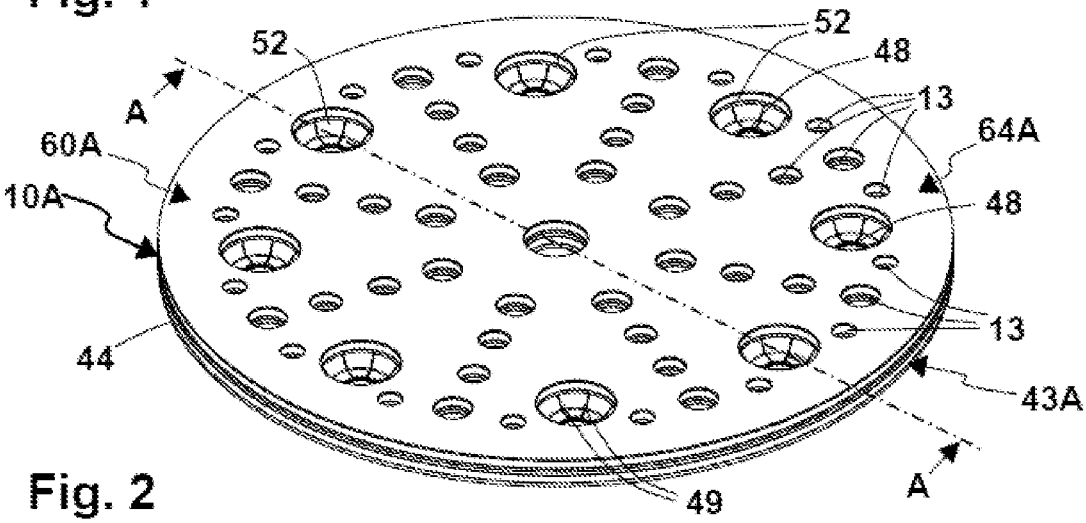
Figure 10:
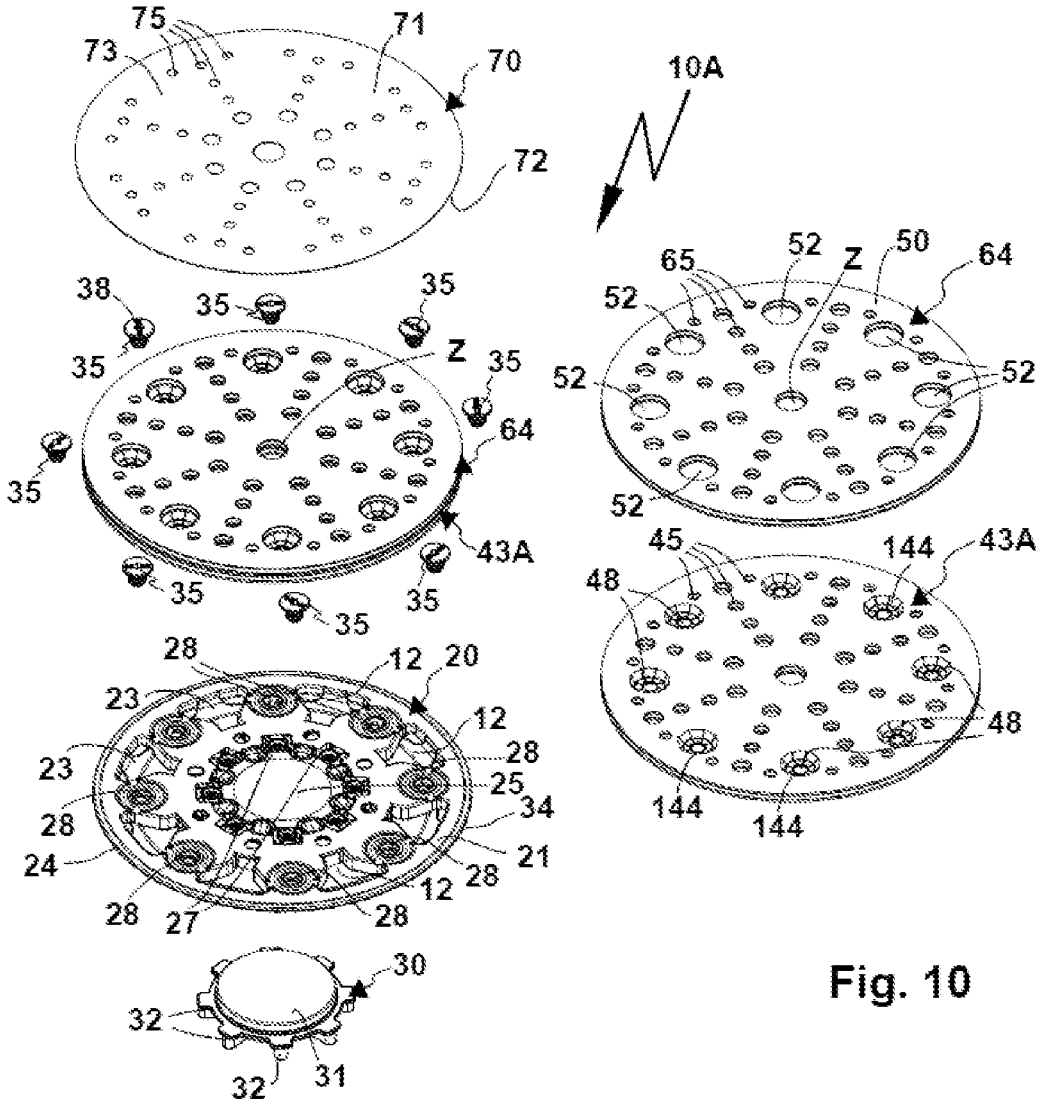
FIG. 10 an exploded view of the disc tool according to FIGS. 1-3 and the sub-components thereof.

However, the depressions 144 shown in FIGS. 2 and 10 do not result until the retaining bolts 35 are screwed into the carrier 20. To illustrate this effect, however, the depressions 144 are illustrated in the composite element 43A shown in perspective, even if the retaining bolts 35 are not shown.

In the case of disc tool 10C, the adhesive layer element 60C has the adhesive layer 50. In order to provide the recess 52, the adhesive layer element 60C has a passage opening 68, the diameter of which is at least the same size as the depression 144 already explained, which results from the application of force onto the cushion element 40C and the retaining wall element 41C by a respective retaining bolt 35. It is also possible for the diameter of the passage opening 68 to be larger than the diameter of the depression 144. Any bulge 145 that may result from this can swell into the region or the plane of the adhesive layer 50 without protruding in front of the adhesive layer 50 in the direction of the processing means 70. The recess or passage opening 68 on the adhesive layer element 60C and therefore the adhesive layer 50 thereof thus forms a displacement cavity 69 for the material of the adhesive layer element 41C and/or the cushion element 40C and/or the composite element 43C. However, due to the weakening and/or removal of the adhesive layer 50, by means of which the recess 52 is formed, the respective bolt head 37 only rests on the retaining wall element 41C and not on the adhesive layer 50, so that the bulge 145 does not form or only to a small extent and/or the bulge 145 does not affect the geometry and/or the profile of the adhesive layer 50.

Figure 14:
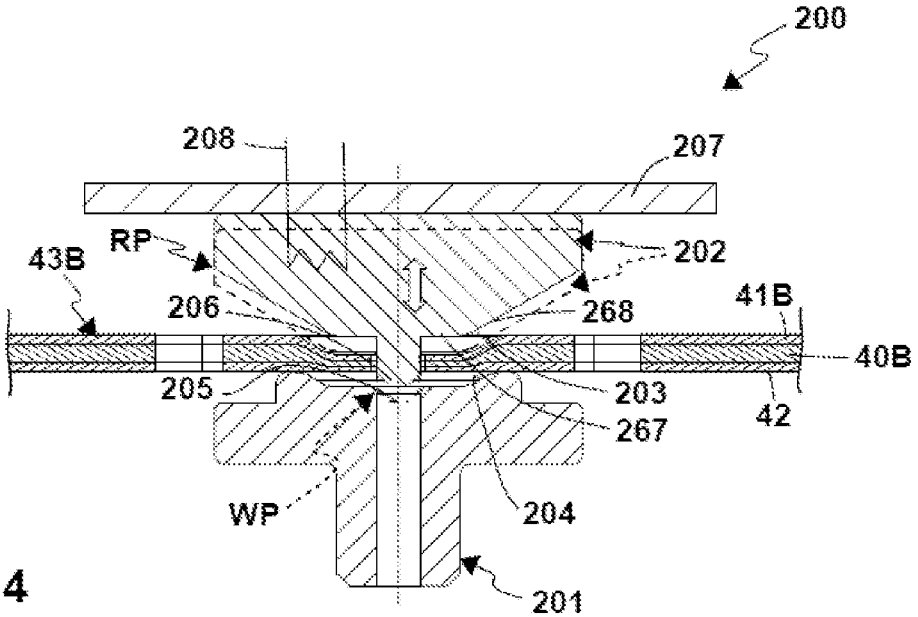
FIG. 14 a schematic view of processing of a composite element for a disc tool using a thermal processing tool.

On the other hand, in the case of disc tool 10B, the adhesive layer 50 is arranged integrally on the retaining wall element 41B. However, the adhesive layer 50 is partially reduced in height or thickness or material strength, for example by means of a thermal and/or plastically deforming and/or pressure-loading processing tool 200 according to FIG. 14 or an abrasive or cutting processing tool 300 according to FIG. 15.

The recesses 52 are formed as depressions in the adhesive layer 50 and/or the retaining wall element 41B, wherein these depressions comprise a section 167 close to the retaining bolt passage openings 48 and a section 168 which has a larger radial distance to the bolt longitudinal axis BL. Consequently, the recesses 52 in the region of sections 167 are deeper in relation to the adhesive layer 50 or the free surface thereof for attaching the processing means 70, while sections 168 are provided at a greater radial distance from the bolt longitudinal axis BL or the retaining bolt passage opening 48, which sections are less deep behind the surface of the adhesive layer 50.

In the region of the sections 167, the adhesive layer 50 and/or the retaining wall element 41B is significantly weakened or no longer exists at all. This makes it possible, for example, for the load on the cushion element 40B and/or the retaining wall element 41B and/or the composite element 43B generated by the bolt heads 37 of the retaining bolts 35 to be reduced and/or balanced, in particular with regard to the adhesive layer 50. In this context, it can advantageously result that the displacement of the material of the cushion element 40B and/or the composite element 43B and/or the retaining wall element 41B is reduced in terms of the formation of a bulge. However, it is also possible that a respective recess 52 accommodates a bulge that forms or is formed by a load on the cushion element 40B and/or the retaining wall element 41B and/or the composite element 43B.

For example, the tool 200 comprises a support element 201, which is opposite an embossing element 202. On its side opposite the support element 201, the embossed element 202 has an embossed contour 203 which interacts with a counter-bearing contour 204 of the support element 201. Embossed contour 203 has a cross-section and/or diameter that corresponds to the cross-section or diameter of the recess 52 of the support element 10B to be produced, i.e., for example, it has section 267 for producing section 167 of the depression or recess 52 and section 268 for producing section 168 of the recess 52. The counter-bearing contour 204 has a profile that matches the embossed contour 203. For example, the counter-bearing contour 204 and the embossing contour 203 have the same cross-sections or diameters.

The support element 201 and the embossed element 202 can have centering contours 205 and 206 for centering with respect to one another. Centering contour 205 is designed as a mount, for example, while centering contour 206 is designed as a projection that can be accommodated by the mount or centering contour 205. The centering projection or the centering contour 206, for example, can penetrate a respective retaining bolt passage opening 48 and then penetrate the mount or centering contour 205.

The embossing element 202 can be adjusted between an embossing position or processing position WP illustrated in dashed lines and a rest position RP illustrated in solid lines by a schematically illustrated actuator 207.

Furthermore, the embossing element 202 is heated using a heater 208. If the embossing element 202 acts on the adhesive layer 50 of the composite element 43B in the manner of an embossing die, the VELCRO™ hooks 51 deform to different extents, which is shown in FIG. 13 as an example for VELCRO™ hooks 51A and 51B. In addition to the depression 52, the VELCRO™ hooks 51 project completely in front of the retaining wall element 41B, while they project less far in front of the retaining wall element 41B in the region of the depression 52, that is to say they have completely or partially melted away. In principle, it is possible for the VELCRO™ hooks 51 to at least partially melt due to the load from the embossing element 202 and the thermal effect.

At this point it should be mentioned that embossing element 202 could also be operated without heating, so that only a mechanical, plastic deformation of the adhesive layer 50 is effected.

Alternatively, it is also possible that embossing element 202 does not have the function of an embossing element, but only provides a deformation contour that acts on the adhesive layer 50 with little force due to the heater 208, so that a thermal deformation of the adhesive layer 50 can essentially be achieved.

Figure 15:
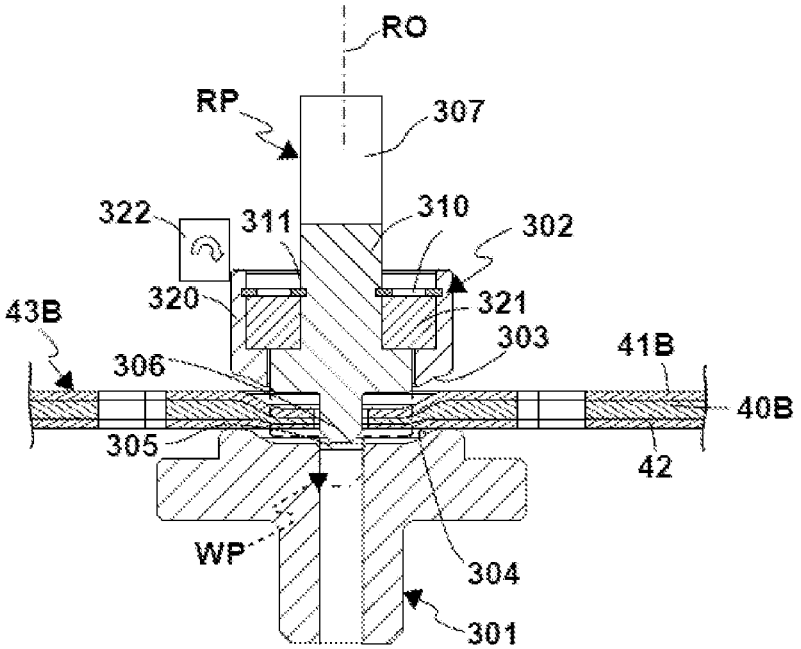
FIG. 15 a schematic view of processing of a composite element for a disc tool using an abrasive or cutting processing tool.

A grinding or abrasive processing is shown in FIG. 15 in connection with the processing tool 300. The processing tool 300 has a support element 301 in the manner of support element 201, which is opposite a grinding tool 302 in the manner of the embossing stamp or embossing element 202.

A counter-bearing contour 304 in the manner of counter-bearing contour 204 is arranged on the support element 301. Support element 301 also has a centering contour 305 in the manner of centering contour 205, which interacts with a centering contour 306 of the processing element 302, i.e., for example, in the manner in which centering contour 206 is designed as a centering projection that can penetrate into a retaining bolt passage opening 48 and into the centering contour 205 designed as a centering mount.

The processing element 302 comprises a support body 310 which can be adjusted, by an actuator 307 in the manner of actuator 207, between a processing position WP shown in dashed lines and a rest position RP shown in solid lines.

A bearing mount 311 for a bearing 321 of a grinding tool 320, which is mounted on the support body 310 so as to be rotatable about an axis of rotation RO, is arranged on the support body 310. The grinding tool 320 can be driven in rotation about the axis of rotation RO by a rotary drive 322, so that a grinding contour 303, which is opposite the support element 301 or the counter-bearing contour 304, can grind the depression 52 into the retaining wall element 41B. Like the embossing contour 203, the grinding contour 303 is adapted to the contour of the recess 52 to be produced.

Figure 3:
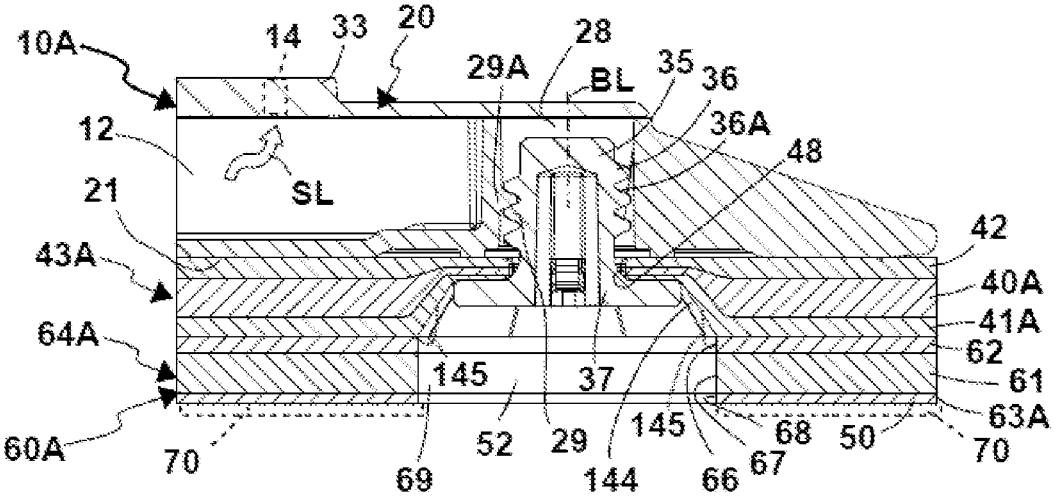
FIG. 3 a section B of FIG. 1.
Figure 4:
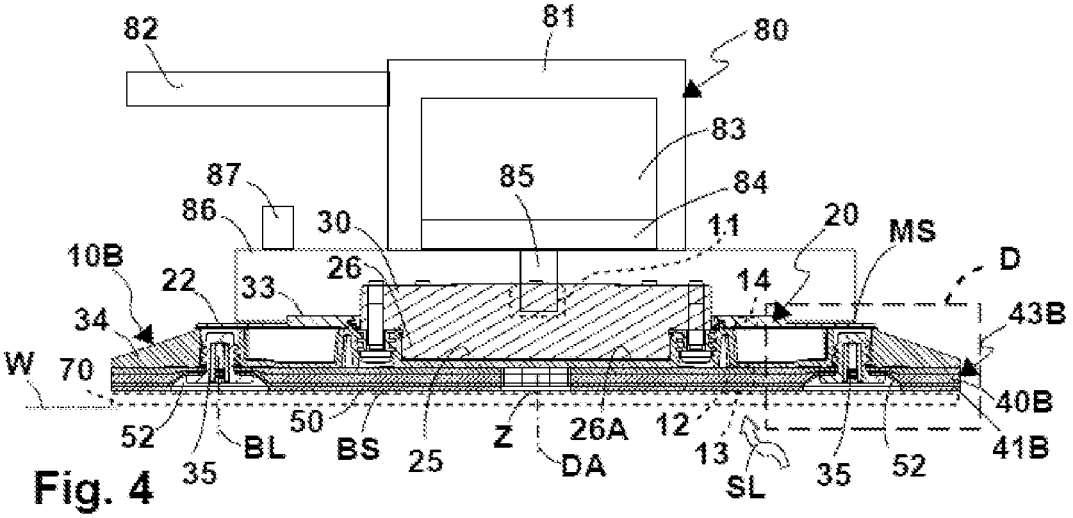
FIG. 4 a schematic view of the processing machine according to FIG. 1 and a sectional view of a second disc tool, approximately along a section line C-C; which is shown in FIG. 5 which shows a cushion element and an adhesive layer of the disc tool according to FIG. 4 in a perspective view from the processing side thereof.
Figure 5:
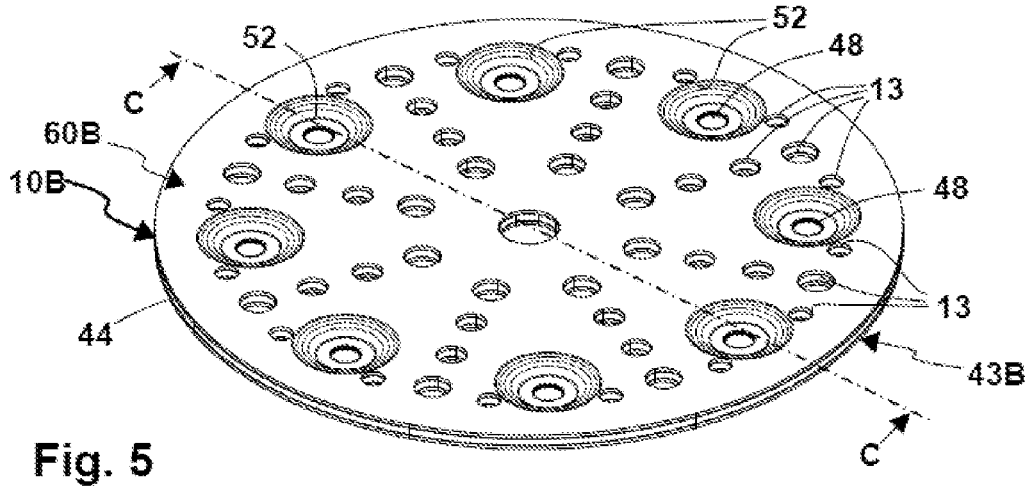
Figure 16:
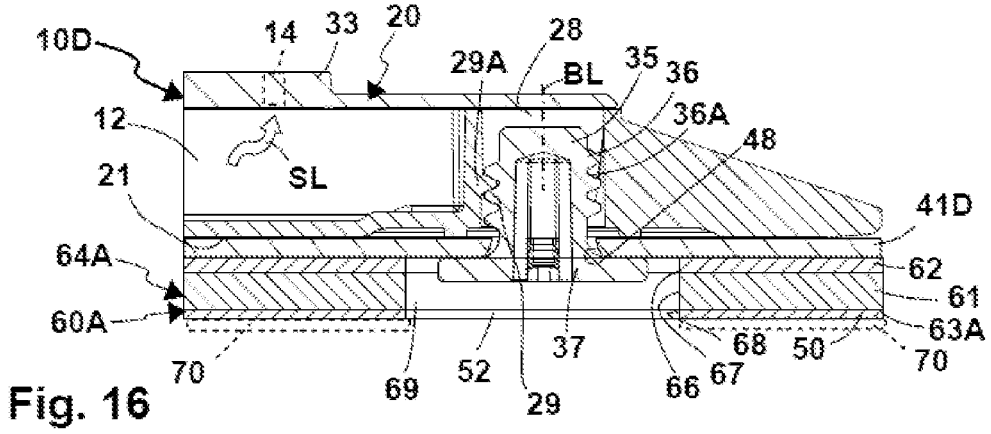
FIG. 16 a variant of the exemplary embodiment of FIGS. 1-3, approximately corresponding to a section as in FIG. 3.

An exemplary embodiment shown in FIG. 16 as a variant of the exemplary embodiment in FIG. 3 of a disc tool 10D can provide, for example, that a retaining wall element 41D in the manner of retaining wall element 41A is present in order to retain the adhesive layer cushion element 61 on the carrier 20. In contrast to the exemplary embodiment according to FIG. 3, however, it is provided that the retaining wall element 41D is screwed directly onto the carrier 20, i.e., in contrast to the exemplary embodiment according to FIG. 3, there is no cushion element 40A and no connecting wall element 42. However, it is also possible for the retaining wall element 41D and the connecting wall element 42 (not shown) to be present, but not the cushion element 40A.

10 Disc tool ABC 60 Adhesive layer element ABC
11 Tool mount 61 Adhesive layer cushion element
12 Flow-passage channels 62 Intermediate wall element
13 Inflow openings 63 Adhesive layer wall A, C
14 Outflow openings 64 Adhesive layer composite element
15 65 Flow-passage channels for 12
16 66 Passage opening
17 67 Passage opening
18 68 Passage opening
19 69 Displacement cavity
20 Carrier 70 Processing means
21 Mounting surface 71 Abrasive sheet
22 Wall surface 72 Mounting side
23 Inflow openings 73 Processing side
24 Outer circumference 74
25 Mount for 30 75 Flow-passage channels for 12
26 Insertion opening base 26A 76
27 Retaining mounts for 32 77
28 Retaining mounts for 35 78
29 Screw mounts screw thread 29A 79
30 Tool-mounting element 80 Processing machine
31 Base body 81 Housing
32 Fastening arms 82 Handle
33 Cover 83 Drive motor
34 Base body 84 Gear
35 Retaining bolts 85 Output
36 Bolt section screw thread 36A 86 Extraction housing
37 Bolt heads 87 Extraction connection
38 Actuating contour slots 88
40 Cushion elements ABC 90
41 Retaining wall element ABCD 91
42 Connecting wall element 92
43 Composite element ABC 93
44 Outer circumference 94
45 Flow-passage channels for 12 95
46 96
47 97
48 Retaining bolt passage openings 98
49 Slots 99
50 Adhesive layer W Workpiece
51 VELCRO™ hook MS Machine side
52 Recesses BS Processing side
53 Retaining bolt passage openings DA Axis
54 BL Bolt longitudinal axis

What is claimed is:

1. A disc tool for a processing machine for grinding and/or polishing a workpiece, wherein the disc tool comprises:

a carrier for attachment to an output of the processing machine, a cushion element made of elastic material arranged on the carrier; and a retaining wall element for retaining the cushion element arranged on the carrier, wherein the retaining wall element is retained on the carrier by means of retaining bolts, wherein respective bolt portions of the retaining bolts extending along respective bolt longitudinal axes and extending through respective retaining bolt passage openings of the retaining wall element are accommodated in respective retaining mounts of the carrier, and the retaining wall element is held between bolt heads of the retaining bolts and the carrier, and wherein an adhesive layer is arranged on a side of the retaining wall element opposite the carrier, and wherein a processing means for grinding and/or polishing the workpiece is releasably attached to the adhesive layer, and wherein the adhesive layer has recesses associated with the bolt heads, the recesses being present before the retaining bolts are screwed into the carrier and cross-sections of the recesses provided to mount the bolt heads are greater than cross-sections of the retaining bolt passage openings respectively, and wherein the disc tool further comprises an adhesive layer element which has an adhesive layer wall with the adhesive layer and is arranged on the retaining wall element, and wherein the retaining wall element has a hook arrangement and/or hooks for retaining the adhesive layer element.

2. The disc tool according to claim 1, wherein:

a central axis or a center of at least one recess of the recesses is concentric with respect to the bolt longitudinal axis of the retaining bolt accommodated in the at least one recess of the recesses; and/or at least one of the recesses or all of the recesses of the adhesive layer has or have an inner diameter that is at least as large as an outer diameter of the bolt head accommodated in the recess or is larger than the outer diameter of the bolt head accommodated in the recess; and/or a material thickness of the adhesive layer or of the adhesive layer element having and/or supporting the adhesive layer is reduced to provide the recesses; and/or the adhesive layer has passage openings through which the bolt heads can penetrate the adhesive layer; and/or at least one of the recesses or all of the recesses of the adhesive layer has or have a larger cross-section and/or diameter than the bolt heads, so that a distance is advantageously present between an inner circumference of a respective recess and an outer circumference of the bolt head accommodated in the recess, transverse to the bolt longitudinal axis thereof.

3. The disc tool according to claim 1, wherein at least one of the recesses or all of the recesses forms or form a displacement cavity into which components of the retaining wall element and/or of the cushion element can be displaced or are displaced.

4. The disc tool according to claim 1, wherein at least one of the recesses or all of the recesses is or are formed and/or designed for accommodating a bulge of the cushion element and/or of the retaining wall element.

5. The disc tool according to claim 1, wherein at least one of the recesses or all of the recesses is or are deeper with respect to the adhesive layer in a region radially closer to the bolt longitudinal axis of the retaining bolt accommodated therein than in a region further away radially from the bolt longitudinal axis.

6. The disc tool according to claim 1, wherein the retaining wall element consists of a material with a higher tensile strength than the cushion element.

7. The disc tool according to claim 1, wherein the cushion element is arranged as an intermediate layer between the carrier and the retaining wall element.

8. The disc tool according to claim 7, wherein the bolt portions of the retaining bolts pass through the retaining wall element and the cushion element, and/or the cushion element is compressed between the bolt heads of the retaining bolts and the carrier.

9. The disc tool according to claim 7, wherein a connecting wall element is arranged between the cushion element and the carrier, wherein the connecting wall element consists of a material with a higher tensile strength than the elastic material of the cushion element.

10. The disc tool according to claim 9, wherein the cushion element and the retaining wall element and/or the cushion element and the connecting wall element form a sandwich-like connected unit or a composite element, on which the recesses are formed.

11. The disc tool according to claim 1, wherein the recesses are formed by a thermal and/or machining and/or abrasive and/or cutting and/or pressure-loading and/or embossing process that reduces a material thickness of the adhesive the layer and/or of the adhesive layer element having the adhesive layer.

12. The disc tool according to claim 1, wherein the adhesive layer element is held on the retaining wall element in a materially-fitting and/or form-fitting manner.

13. The disc tool according to claim 1, wherein the adhesive layer has a layer with a hook and loop fastener arrangement for retaining the processing means.

14. The disc tool according to claim 1, wherein the adhesive layer and the cushion element consist of different materials and/or are different layers.

15. The disc tool according to claim 1, wherein the disc tool further comprises flow-passage openings and/or an opening for a tool mount of the disc tool provided for attachment to the output of the processing machine, and wherein the adhesive layer completely or essentially completely covers a side of the disc tool facing away from the carrier, apart from the flow-passage openings and/or the opening for a tool mount of the disc tool.

16. The disc tool according to claim 1, wherein slots extend radially away from the retaining bolt passage openings, so that a region of the retaining wall element surrounding a respective retaining bolt passage opening is segmented.

17. The disc tool according to claim 1, wherein a tool mount or a tool-mounting element having a tool mount is arranged on the carrier, wherein the disc tool can be detachably connected to the output of the processing machine by means of the tool mount.

18. The disc tool according to claim 1, further comprising at least one flow-passage channel for air, which has inflow openings on the adhesive layer and outflow openings on the carrier, wherein air can flow through the at least one flow-passage channel from the adhesive layer in the direction of the carrier or, vice versa, from the carrier in the direction of the adhesive layer.

19. The disc tool according to claim 1, wherein the processing means is an abrasive sheet and/or the disc tool comprises the processing means.

20. The processing machine with the disc tool according to claim 1, wherein the processing machine has a drive with a drive motor for the disc tool, by means of which the disc tool can be driven by the processing machine to perform a rotary and/or eccentric and/or oscillatory movement.

21. The processing machine according to claim 20, further comprising a long-neck grinder.

22. A disc tool for a processing machine for grinding and/or polishing a workpiece, wherein the disc tool comprises:

a carrier for attachment to an output of the processing machine, a cushion element made of elastic material arranged on the carrier; and a retaining wall element for retaining the cushion element arranged on the carrier, wherein the retaining wall element is retained on the carrier by means of retaining bolts, wherein respective bolt portions of the retaining bolts extending along respective bolt longitudinal axes and extending through respective retaining bolt passage openings of the retaining wall element are accommodated in respective retaining mounts of the carrier, and the retaining wall element is held between bolt heads of the retaining bolts and the carrier, and wherein an adhesive layer is arranged on a side of the retaining wall element opposite the carrier, and wherein a processing means for grinding and/or polishing the workpiece is releasably attached to the adhesive layer, and wherein the adhesive layer has recesses associated with the bolt heads, the recesses being present before the retaining bolts are screwed into the carrier and cross-sections of the recesses provided to mount the bolt heads are greater than cross-sections of the retaining bolt passage openings respectively, and wherein the disc tool further comprises an adhesive layer element which has an adhesive layer wall with the adhesive layer and is arranged on the retaining wall element, and wherein the adhesive layer element has at least one adhesive layer cushion element made of an elastic material arranged between the adhesive layer wall and the retaining wall element.

23. The disc tool according to claim 22, wherein the retaining wall element has a hook arrangement and/or hooks for retaining the adhesive layer element.

24. The disc tool according to claim 22, wherein the at least one adhesive layer cushion element has passage openings through which the bolt heads penetrate and/or through which the bolt heads can be inserted or have been inserted freely, and/or the at least one adhesive layer cushion element is not tensioned by the bolt heads against the carrier and/or the at least one adhesive layer cushion element is arranged on the adhesive layer element on a side facing away from the bolt heads.

25. The disc tool according to claim 22, wherein the adhesive layer element has an intermediate wall element which is arranged between the adhesive layer cushion element and the retaining wall element and is connected to the retaining wall element.

26. The disc tool according to claim 25, wherein the intermediate wall element consists of a material which has a higher tensile strength than the adhesive layer cushion element.

27. A disc tool for a processing machine for grinding and/or polishing a workpiece, wherein the disc tool comprises:

a carrier for attachment to an output of the processing machine, a cushion element made of elastic material arranged on the carrier; and a retaining wall element for retaining the cushion element arranged on the carrier, wherein the retaining wall element is retained on the carrier by means of retaining bolts, wherein respective bolt portions of the retaining bolts extending along respective bolt longitudinal axes and extending through respective retaining bolt passage openings of the retaining wall element are accommodated in respective retaining mounts of the carrier, and the retaining wall element is held between bolt heads of the retaining bolts and the carrier, and wherein an adhesive layer is arranged on a side of the retaining wall element opposite the carrier, and wherein a processing means for grinding and/or polishing the workpiece is releasably attached to the adhesive layer, and wherein the adhesive layer has recesses associated with the bolt heads, the recesses being present before the retaining bolts are screwed into the carrier and cross-sections of the recesses provided to mount the bolt heads are greater than cross-sections of the retaining bolt passage openings respectively, and wherein the disc tool further comprises an adhesive layer element which has an adhesive layer wall with the adhesive layer and is arranged on the retaining wall element, and wherein the adhesive layer element has at least one adhesive layer cushion element made of an elastic material arranged between the adhesive layer wall and the retaining wall element, and wherein the adhesive layer element has an intermediate wall element which is arranged between the adhesive layer cushion element and the retaining wall element and is connected to the retaining wall element, and wherein the adhesive layer cushion element and the intermediate wall element and/or the adhesive layer wall form a sandwich-like connected unit of the adhesive layer element or an adhesive layer composite element of the adhesive layer element, on which the recesses are formed.

* * * * *